United States Patent [19]

Wurst et al.

[11] Patent Number: 4,819,457

[45] Date of Patent: Apr. 11, 1989

[54] YARN GUIDE ELEMENT FOR TEXTILE MACHINES

[75] Inventors: Dieter Wurst; Gerhard Nissle, both of Reutlingen, Fed. Rep. of Germany

[73] Assignee: H. Stoll GmbH & Co., Reutlingen, Fed. Rep. of Germany

[21] Appl. No.: 122,222

[22] Filed: Nov. 18, 1987

[30] Foreign Application Priority Data

Dec. 4, 1986 [DE] Fed. Rep. of Germany ..... 3641426

[51] Int. Cl.[4] ..... D04B 15/44

[52] U.S. Cl. ..... 66/146; 242/147 B

[58] Field of Search ..... 66/146; 242/147 R, 153, 242/154; 226/185

[56] References Cited

U.S. PATENT DOCUMENTS

| | | | |
|---|---|---|---|
| 252,018 | 1/1882 | Colahan | 242/154 |
| 356,377 | 1/1887 | Rose | 242/154 |
| 1,187,912 | 6/1916 | Houghton | 242/154 |
| 1,254,761 | 1/1918 | Bailey | 242/147 |
| 1,467,443 | 9/1923 | Meritt | 242/154 |
| 1,596,095 | 8/1929 | Gehman | 242/154 |
| 1,997,709 | 4/1935 | Williams | 242/154 |
| 2,528,171 | 10/1950 | Pehlivanian | 242/147 |
| 4,720,985 | 1/1988 | Goller et al. | 66/146 |

FOREIGN PATENT DOCUMENTS

| | | | |
|---|---|---|---|
| 2263569 | 7/1974 | Fed. Rep. of Germany | 242/154 |
| 55-161754 | 12/1980 | Japan | 242/153 |
| 369389 | 1/1960 | Switzerland | 242/153 |

*Primary Examiner*—Ronald Feldbaum
*Attorney, Agent, or Firm*—Larson and Taylor

[57] ABSTRACT

The yarn guide element for textile machines comprises a longitudinally extending guide member oriented along a yarn path and having a smooth upper surface free of edges, in particular a tensioned wire (15). In flat knitting machines, the guide members comprising a tensioned wire (15) can be arranged singly or as a plurality spaced from one another and parallel to and beneath the yarn feeder rails (20/1–20/3) and can extend over the whole active length of the needle beds. (FIG. 6).

2 Claims, 4 Drawing Sheets

YARN GUIDE ELEMENT FOR TEXTILE MACHINES

DESCRIPTION

The invention relates to a yarn guide element for textile machines.

In textile machines, the yarns are led from a yarn storage position to a yarn working position so as to extend to a large extent freely between yarn guide positions formed by yarn guide eyes. By the action of additional devices, the yarn is tensioned to a sufficient extent so as to maintain it in its guide path. It is also known to guide the yarn in a tube in dangerous regions of textile machines in order to protect it. With heavy threads, especially threads comprising metal filaments, the danger of the thread sagging is increased for freely guided threads. This danger is especially present in flat knitting machines where the threads must run horizontally over rather long distances without guidance from the ends of the needle beds to yarn guides which are movable in two directions. In this situation, the threads cannot be guided in tubes, which in any case involve the danger of stoppage due to fibre abrasion.

The problem which is the basis of the invention is to provide a yarn guide element for textile machines with which undesired sagging of an openly guided thread or yarn will be avoided.

The problem set forth is solved according to the invention by means of a yarn guide element which is characterised by a longitudinally extending guide member oriented along a yarn path and having a smooth upper surface free of edges and around which the yarn is laid in at least one winding having the form of a screw thread. Advantageously, the guide member can be a tensioned wire.

The smooth guide member serves as a support for the openly guided yarn or thread. Since the yarn is not wound on the guide member with numerous turns, but only rests on it loosely at a few places, the braking effect of the guide member on the moving yarn is so small that it can be accepted.

The effect of the yarn guide element constructed according to the invention is especially advantageous when it is used in flat knitting machines where at least one guide member in the form of a tensioned wire can be disposed parallel to each yarn feeder rail. Suitably, in this connection, several tensioned wires can be arranged in each case spaced from one another beneath the yarn feeder rail in the regions between the yarn feeder arms to serve as guide members, which extend over the whole active length of the needle beds. The wires can advantageously be held continually under tension by means of tension springs so that increases in length of such wires, for example wires of synthetic plastics material, due to ageing can be compensated for.

There will be described below, by way of example, in relation to the accompanying drawings, yarn guide elements according to the invention as applied to a flat knitting machine.

Figure 1:
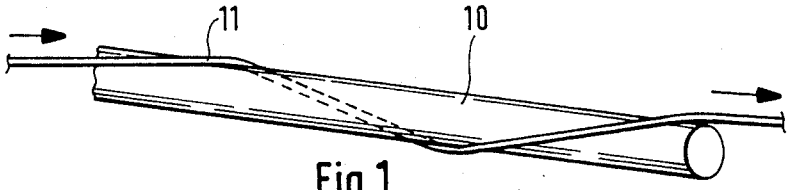
Figure 2:
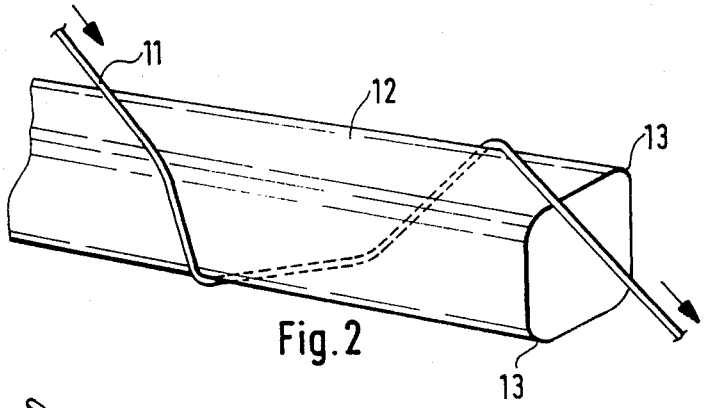
Figure 3:
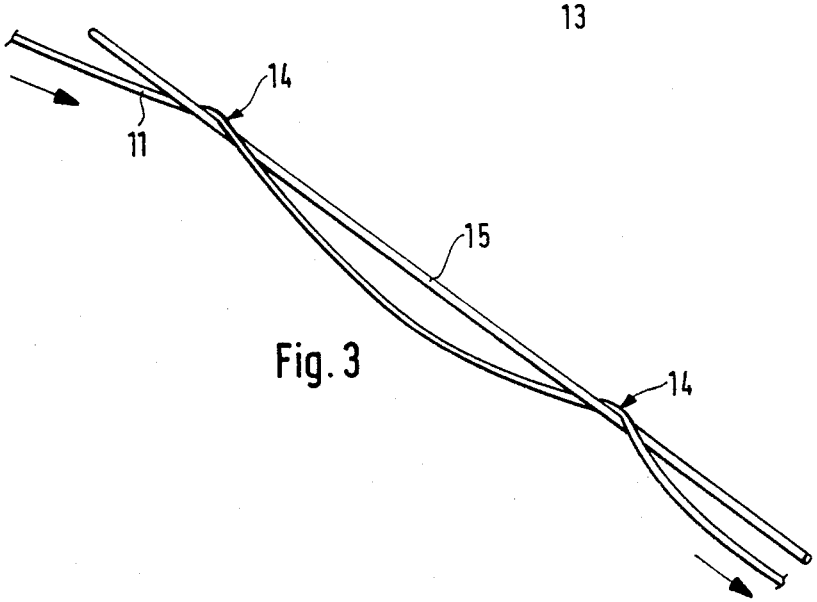
Figure 4:
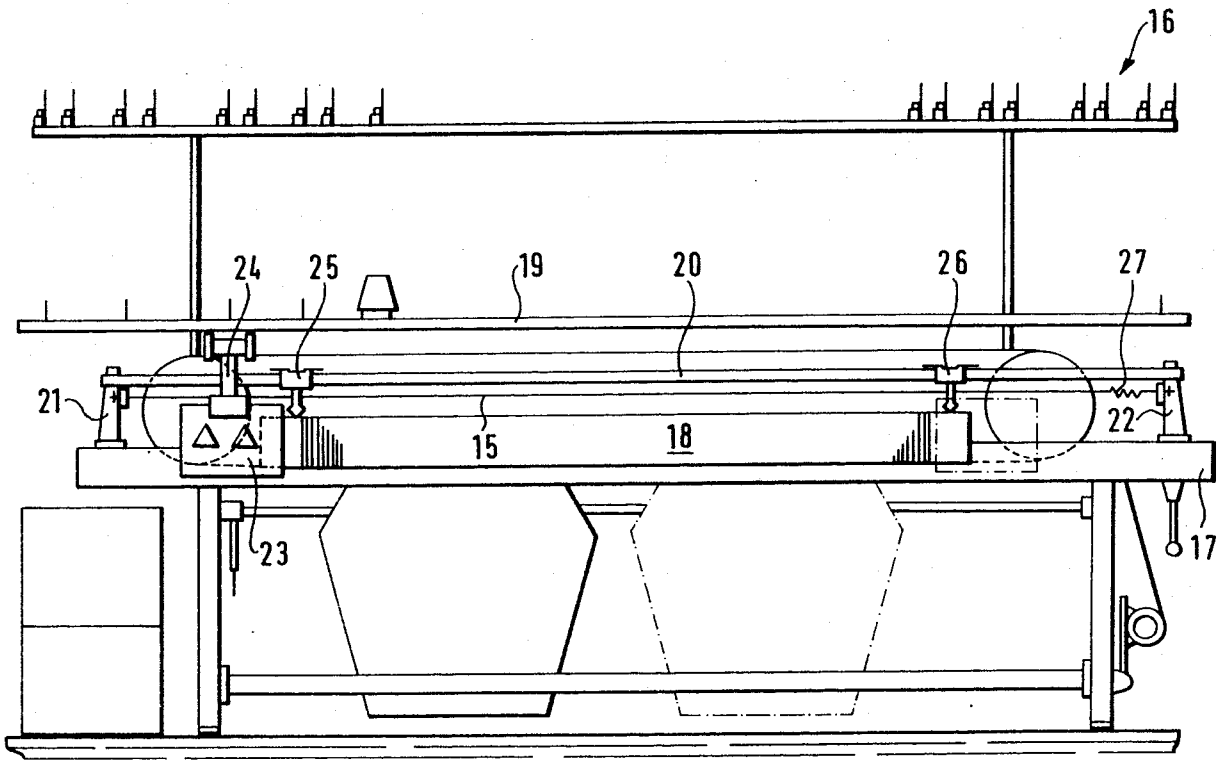
Figure 5:
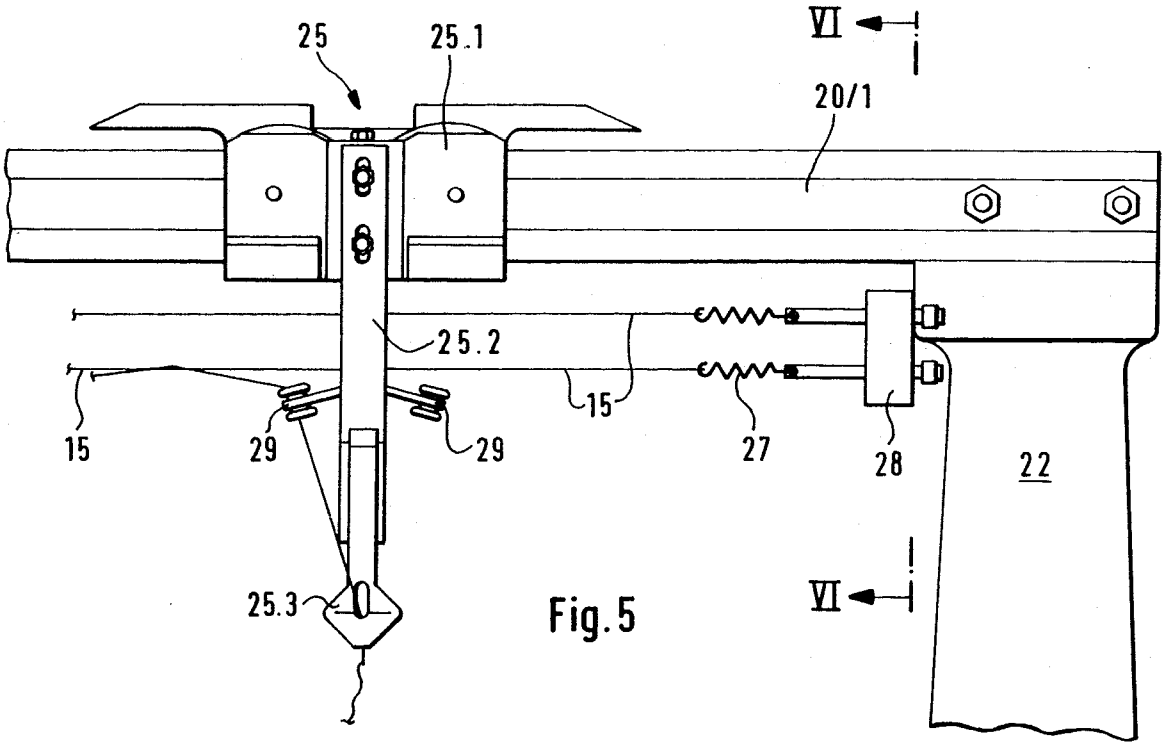
Figure 6:
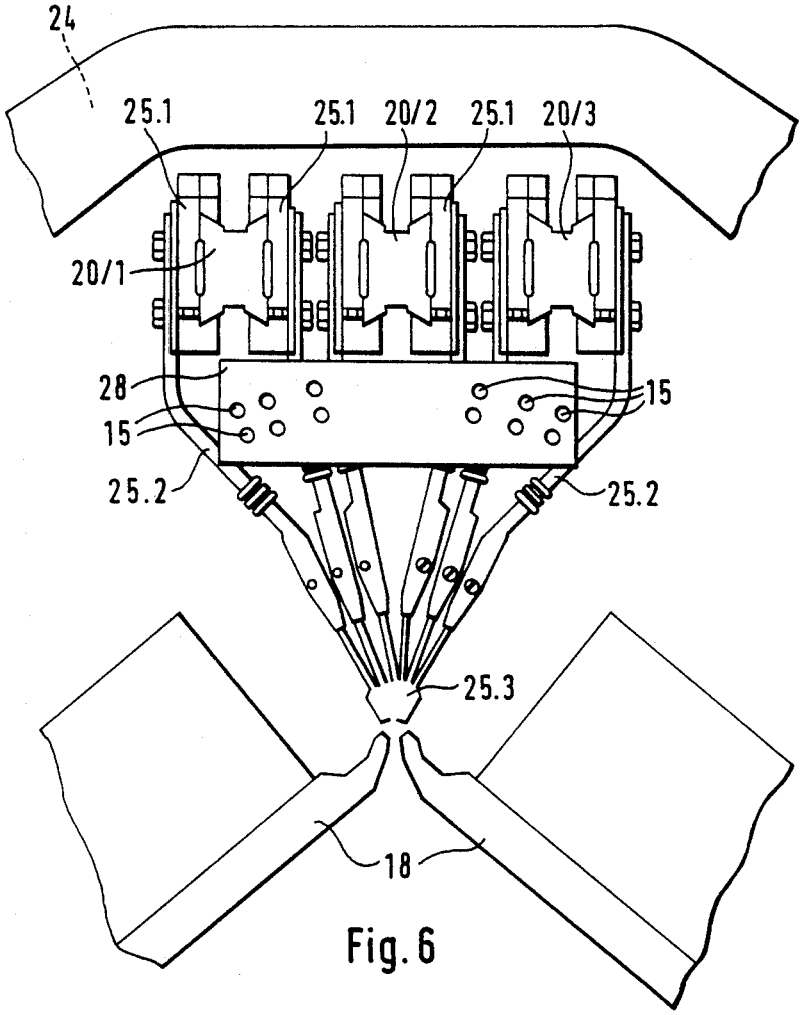

In detail there is shown in:

FIG. 1 a first embodiment of a yarn guide element;

FIG. 2 a second embodiment of a yarn guide element;

FIG. 3 as a third embodiment of a yarn guide element, a tensioned wire serving as a guide member for a yarn;

FIG. 4 a schematic front view of a flat knitting machine with yarn guide elements constructed according to the invention;

FIG. 5 a partial view on a larger scale than FIG. 4 of the end region of yarn feeder rail of a flat knitting machine;

FIG. 6 a section through the yarn feeding arrangement of the flat knitting machine along the line VI—VI in FIG. 5.

FIG. 1 shows a piece of a rod 10 of synthetic material with a circular cross-section, which serves as a guide member for a moving yarn 11, which is laid around the smooth rod of synthetic material in a single winding having the form of a screw thread.

FIG. 2 shows a guide member 12, also of synthetic material, with a smooth upper surface and in the form of a rectangular rod with strongly rounded corners 13. The moving yarn 11 to be supported is also laid around this guide member in a single winding.

FIG. 3 shows a guide member in the form of a tensioned wire 15 around which the moving yarn 11 is wound in a few loose turns, so that in practice it only touches the wire 15 at a few places 14.

FIG. 4 shows a schematic front view of a flat knitting machine 16 with a support 17 for at least one needle bed 18, with a bobbin table 19 and with a yarn feeder rail 20 extending above the needle bed 18 between two uprights 21 and 22. The cam carriage 23 is shown schematically at the left hand end of the needle bed 18 with its bow 24 crossing over the yarn feeder rail. Two yarn feeders 25 and 26 are indicated on the yarn feeder rail 20.

The flat knitting machine 16 is provided with guide members in the form of smooth wires 15 for the yarns, which are not shown, and the smooth wires are stretched parallel to and below the yarn feeder rails 20 between the two uprights 21 and 22 carrying the yarn feeder rails 20 and are held in tension by means of a tension spring 27 shown in the region of the upright 22. The wires 15 serve as guide members for the yarns on their essentially horizontal path which extends from the ends of the needle beds to the yarn feeders 25 or 26 movable longitudinally of the needle beds 18.

FIGS. 5 and 6 show a corresponding arrangement of several wires 15 on a flat knitting machine, which has three double yarn feeder rails 20/1, 20/2 and 20/3 on each of which the slides 25.1 of several yarn feeders 25 can be mounted. Each yarn feeder has, in known manner, a yarn feeder arm 25.2 which extends downwardly to a position close to the knitting region of the machine and which ends in a yarn guide head 25.3. A separate wire 15 is provided as a guide member for each yarn. According to FIG. 6, the wires 15 beneath the yarn feeder rails 20/1–20/3 are stretched so as to pass between the yarn feeder arms 25.2 of the individual yarn feeders 25 and their position is determined by a special anchoring plate 28 shown only schematically in FIGS. 5 and 6. The yarns are laid around the tensioned wires with a few turns in each case in a similar manner to FIG. 3 and in accordance with FIG. 5 are lead away from the tensioned wire to one of two yarn guide eyes 29 at the sides of the yarn feeder arm 25.2 of the associated yarn feeder 25 and from there further to the yarn feeder head 25.3. Yarn tension devices, not shown, act on the yarns in the usual way, and bring about a retraction of the yarn guided over a tensioned wire 15, as a yarn guide member, on retrograde movement of a yarn feeder 25. When using the yarn feeder elements on textile machines, other yarn guide elements, such as yarn guide eyes can, as a rule, be partly dispensed with.

We claim:

1. A yarn guide apparatus for flat knitting machines having (a) needle beds, (b) parallel yarn feeder rails extending above the needle beds, (c) yarn feeders mounted on respective yarn feeder rails, and (d) respective yarn feeder arms depending from the yarn feeders which yarn feeder arms are horizontally spaced from one another, the yarn guide apparatus comprising:

a plurality of smooth wires disposed in regions between the feeder arms and parallel to the feeder rails such that a respective yarn is laid about a respective said wire at least one turn;

a fixing means for fixing said wires at one end of the needle beds; and a resilient fixing means for fixing said wires at the other end of the needle beds, said resilient fixing means including a tension spring for each said wire.

2. A yarn guide apparatus for a textile machine comprising:

a smooth wire having two ends which said wire serves to guide a yarn loosely laid about said wire at least one turn;

a fixing means for fixing one said end of said wire to the textile machine; and a resilient fixing means for fixing the other said end of said wire to the textile machine such that said wire is stretched along a yarn path of the textile machine, said resilient fixing means including a tension spring for tensioning said wire.

* * * * *